US007117610B2

(12) United States Patent
Bailey

(10) Patent No.: US 7,117,610 B2
(45) Date of Patent: Oct. 10, 2006

(54) TOOL FOR SCRIBING TILE

(76) Inventor: Michael Bailey, 78 Morris Ave., Lewiston, ME (US) 04240

( * ) Notice: Subject to any disclaimer, the term of this patent is extended or adjusted under 35 U.S.C. 154(b) by 0 days.

(21) Appl. No.: 11/009,676

(22) Filed: Dec. 10, 2004

(65) Prior Publication Data

US 2006/0123648 A1 Jun. 15, 2006

(51) Int. Cl.
*G01B 5/00* (2006.01)
*G01B 5/20* (2006.01)

(52) U.S. Cl. ..... 33/526; 33/561.1

(58) Field of Classification Search ..... 33/526, 33/527, 561.1, 561.2, 561.3, 562, 566
See application file for complete search history.

(56) References Cited

U.S. PATENT DOCUMENTS

| | | | | | |
|---|---|---|---|---|---|
| 66,946 | A | * | 7/1867 | Burt et al. | 33/561.1 |
| 2,144,697 | A | * | 1/1939 | Zangrando | 33/527 |
| D136,978 | S | * | 1/1944 | Tomasini | 33/561.1 |
| 2,424,042 | A | * | 7/1947 | Lundberg | 33/561.3 |
| 2,612,700 | A | * | 10/1952 | Frisk | 33/561.1 |
| 4,353,171 | A | * | 10/1982 | Spears | 33/561.1 |
| 4,899,455 | A | * | 2/1990 | Bovino et al. | 33/527 |
| 4,928,391 | A | | 5/1990 | Higgins et al. | |
| 4,956,924 | A | * | 9/1990 | Hu | 33/561.1 |
| 4,965,935 | A | | 10/1990 | Bourque | |
| 4,991,307 | A | | 2/1991 | Higgins | |
| 5,188,013 | A | | 2/1993 | Cardinale | |
| 5,293,694 | A | | 3/1994 | Swindle | |
| 5,361,508 | A | * | 11/1994 | Ruggiero | 33/527 |
| 5,560,274 | A | | 10/1996 | Turner | |
| 5,617,642 | A | * | 4/1997 | Marios | 33/526 |
| 5,701,680 | A | * | 12/1997 | Garcia et al. | 33/526 |
| 6,481,112 | B1 | * | 11/2002 | White | 33/527 |
| 6,523,272 | B1 | * | 2/2003 | Morales | 33/526 |
| 2001/0018856 | A1 | | 9/2001 | Fouy | |
| 2003/0033724 | A1 | | 2/2003 | Barbosa | |
| 2003/0196407 | A1 | | 10/2003 | Rossi | |
| 2003/0235478 | A1 | | 12/2003 | Stoscher et al. | |
| 2004/0025662 | A1 | | 2/2004 | Comas | |
| 2004/0030733 | A1 | | 2/2004 | Bell | |

FOREIGN PATENT DOCUMENTS

| | | | |
|---|---|---|---|
| GB | 2036328 | A * | 6/1980 |
| GB | 2267757 | A * | 12/1993 |

OTHER PUBLICATIONS

Magic-Mark-It, www.tiletool.net, on sale as of today's date Mar. 9, 2005.

* cited by examiner

*Primary Examiner*—Christopher W. Fulton
(74) *Attorney, Agent, or Firm*—Pierce Atwood LLP; Kevin M. Farrell

(57) ABSTRACT

The present invention is a tool for scribing tile, including a base member that defines a substantially planar surface, preferably rectangular in design, and more preferably with a small cutout in one end for particular applications. The base member preferably approximates the size of a tile to be laid. The base member is slidably coupled to a series of edge members and center members that are movable with respect to each other as well as the base member. The edge and center members are slidably fastened to the base member, thus permitting the tool to mimic a number of shapes and sizes depending upon the shape and size of tile to be cut.

7 Claims, 4 Drawing Sheets

TOOL FOR SCRIBING TILE

BACKGROUND AND SUMMARY OF THE INVENTION

The present invention relates to the measuring and cutting of tiles for installation. More specifically, the present invention relates to a tool for scribing a tile to be installed in a location and precisely determining the cut of the tile such that it fits into the installation location. When tiles are installed on a wall, floor or other surface, the tiles in the center of the surface can be installed as whole tiles, the tiles around the edges and/or around other objects such as door jams on the surface may have to be cut prior to installation to fit the surface being tiled.

Common practice for tiling surfaces today requires the repeated measurement of tiles, grouting, and distances to walls, moldings, and other obstructions. Large measuring devices that incorporate a cutting feature are often used for these purposes, thus requiring the repeated transport of often-heavy tiles from the machine to their destination. Moreover, each and every tile must be separately measured and cut, which increases the inefficiencies and risk of error in the endeavor.

Tile that is incorrectly measured, chipped, dropped, or otherwise mishandled cannot be used, and any wasted tile correlates to an increase in cost. Moreover, the increased time involved in moving, measuring, and cutting the tiles may also result in increased costs, and thus the user may find himself in a dilemma. Professional tile installation is expensive, and a good deal of those costs is attributable to the labor associated with the task. On the other hand, the user suffers from a lack of reliable and cost-efficient tools on the market to do the tiling himself. As such, there is a need in the art for an economical and efficient tool that can be used by anyone, professional or otherwise, who needs to reliably and quickly measure, mark and place a series of tiles around a number of orientations and obstacles.

Accordingly, the present invention includes a tool for scribing tile that is readily adaptable for use by those wanting to tile a surface in a precise and economical fashion. In particular, the present invention includes a base member that defines a substantially planar surface, preferably rectangular in design, and more preferably with a small cutout in one end for particular applications. The base member preferably approximates the size of a tile to be laid. The base member is slidably coupled to a series of edge members and center members that are movable with respect to each other, as well as the base member. The edge and center members are slidably fastened to the base member, thus permitting the tool to mimic a number of shapes and sizes depending upon the shape and size of tile to be cut.

In operation, the tool of the present invention provides an efficient and reliable manner for scribing tile. The tool can be adjusted such that its dimensions are representative of a tile and the surrounding grout. A fresh tile is then placed directly on top of a previously laid tile, and the tool is disposed on the fresh tile such that the tool abuts a wall on one end and partially exposes the fresh tile on the other end. The portion of the fresh tile that is exposed is the same shape as the tile that is to be laid, including any room for grout.

Moreover, unlike much of the existing art, the tool of the present invention can be used against flat walls, angled walls, corners and door jams. Of particular note is that the present invention contains a plurality of moving members that are all movable relative to each other and to the base member. In embodiments discussed below, the members can be oriented to conform to the shape of flat surfaces, corners and door jams. Thus, the members can be oriented in a planar fashion to represent a rectangular plate, or the members can be moved independently for scribing tile in difficult circumstances, such as a door jam. In sum, the present invention is an economical and useful tool that is adaptable for a number of uses in the art of tile scribing.

The foregoing is intended as a summary of the novel and useful features of the present invention. Further aspects, features and advantages of the invention will become apparent from consideration of the following detailed description and the appended claims when taken in connection with the accompanying drawings.

DETAILED DESCRIPTION OF THE PRESENT INVENTION

Figure 1:
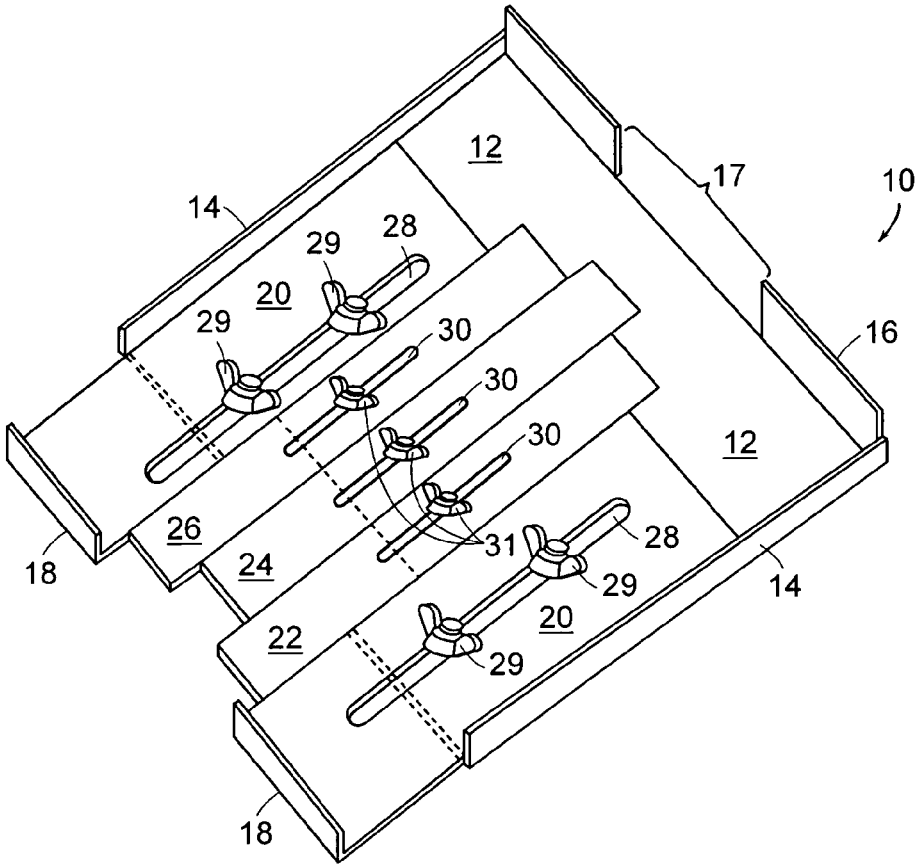
FIG. 1 is a perspective view of the tool for scribing tile of the present invention.
Figure 2:
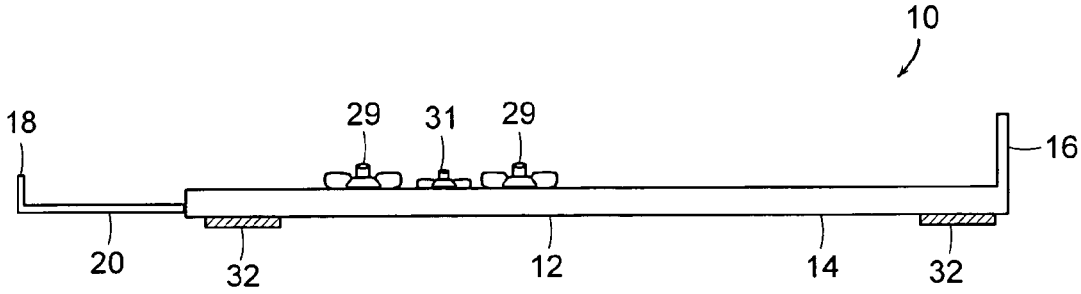
FIG. 2 is a cross-sectional view of the tool for scribing tile of the present invention.

Referring to FIGS. 1 and 2, a tool 10 for scribing tile is shown in one of its preferred embodiments. As illustrated in the plan view of FIG. 1, the tool 10 includes a base member 12 that defines a substantially planar surface. The base member 12 is preferably rectangular in design, and more preferably has a small cutout in one end (shown in phantom in FIG. 1). The base member 12 preferably approximates the size of a tile to be laid. Thus, the exact size of the base member 12 will vary depending on the application for which it is used. The base member 12 is skirted on its edges by skirts 14. A lip 16 defining a passage 17 is also shown on one end of the base member 16. As shown in FIG. 2, the base member 12 may have a plurality of feet 32 disposed on its bottom side for secure and stable placement on a tile to be scribed.

A pair of edge members 14 is slidably disposed on opposing sides of the base member 12. The edge members 20 define edge openings 28 that are preferably oblong in shape. The edge members 20 are slidably attached to the base member 12 by fasteners 29. In one embodiment, the fasteners 29 would comprise bolts that project from the base member 12 through the edge openings 28, to which wing-nuts or other securing mechanisms could be attached. It should be understood that the fasteners 29 can be selectively engaged, and disengages such that the edge members 20 are movable with respect to the base plate 12, and the direction and degree of movement is determined by the edge openings 28. The edge members 14 define lips 18 that are similar to the skirts 14 and lip 16 discussed above.

The tool 10 also includes a plurality of center members 22, 24, 26 that are disposed on the base member 12 between the edge members 14. The center members 22, 24, 26 define center openings 30 that are preferably oblong in shape. The center members 22, 24, 26 are slidably attached to the base member 12 by fasteners 31. In one embodiment, the fasteners 31 would comprise bolts that project from the base member 12 through the center openings 30, to which wing-nuts or other securing mechanisms could be attached.

In a preferred embodiment, there are three center members 22, 24, 26 on a tool 10 for permitting the use of the tool 10 against a door jam, as discussed in greater detail below. It should be understood that the fasteners 31 can be selectively engaged, and disengages such that the center members 22, 24, 26 are movable with respect to the base plate 12, and the direction and degree of movement is determined by the edge openings 28. The center members 22, 24, 26 are also independently movable with respect to each other, as well as with respect to the edge members 20. In particular applications discussed below, the center members 22, 24, 26 are passable through the passage 17, thus permitting the tool 10 to be used in situations in which the tile to be cut is not rectangular in profile.

Figure 3A:
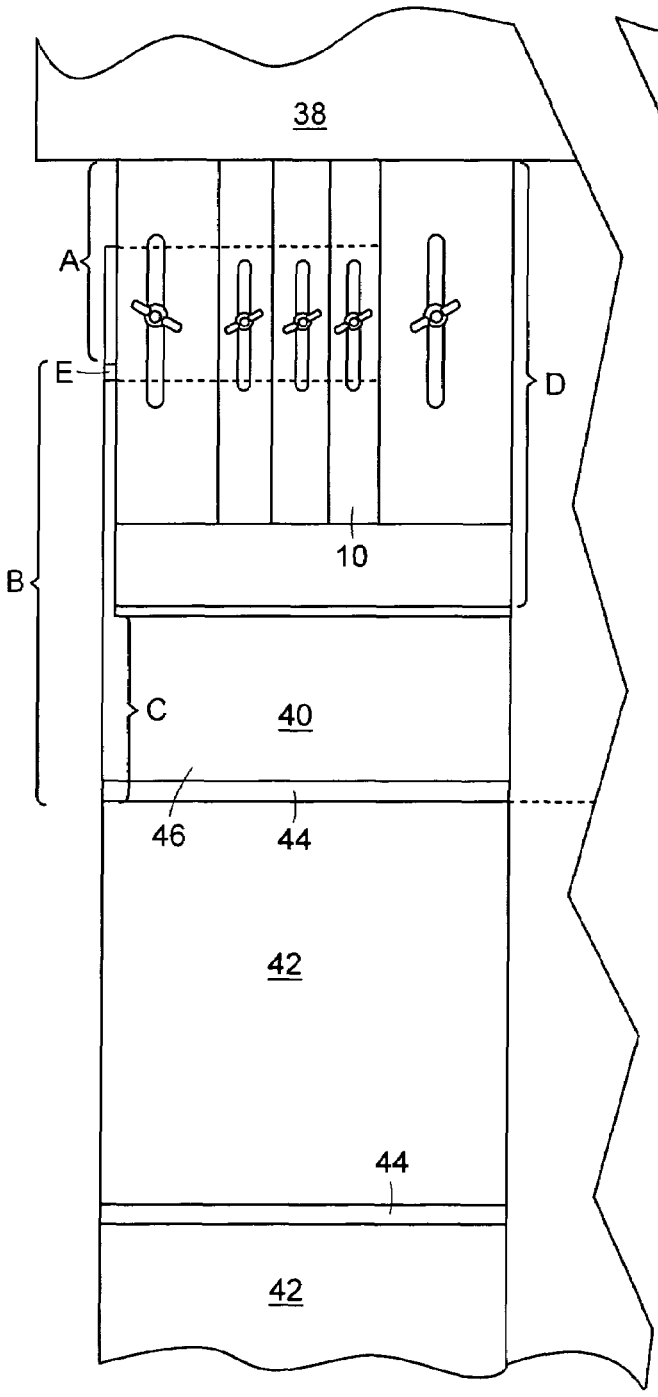
FIGS. 3A and 3B are a split view of the present invention in use showing a schematic plan view of the tool and a schematic cross-sectional view of the tool.
Figure 3B:
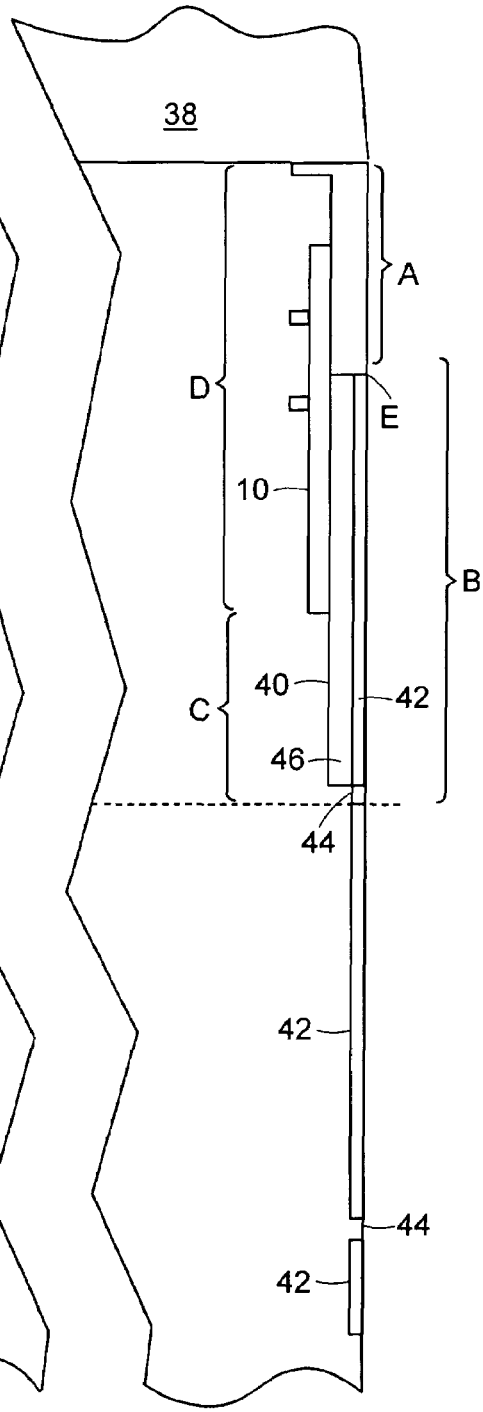

FIGS. 3A and 3B are a split schematic view of the present invention in use showing a plan view of the tool and a cross-sectional view of the tool 10. Referring to both Figures now, the tool 10 is shown placed on a series of placed tile 42, which is typically separated by grout 44. A wall 38 or other structure that is not to be tiled is partially shown as well.

In operation, the tool 10 of the present invention provides an efficient and reliable manner for scribing tile. A fresh tile 40 is placed directly on top of the tile 42 that is nearest the wall 38, where a tile is to be inserted in space A. The tool 10 is then placed directly over the fresh tile 40 such that it abuts the wall 38 on one end and partially exposes the fresh tile 40 on the other end. The length B is the gross length of the tile 42, as well as any surrounding grout 44 and any space left for grouting the fresh tile 40 defined by space E. When the tool 10 is extended to its required length D, the fresh tile 40 that remains exposed will be of length C. Length C is equal to length A, and therefore, the user may mark or scribe the fresh tile 42 along the junction between the tool 10 and the fresh tile 40 and make a reliable cut, thereby creating a new tile portion 46 that is designed to fit in space A, including any grout 44 that is required.

Figure 4:
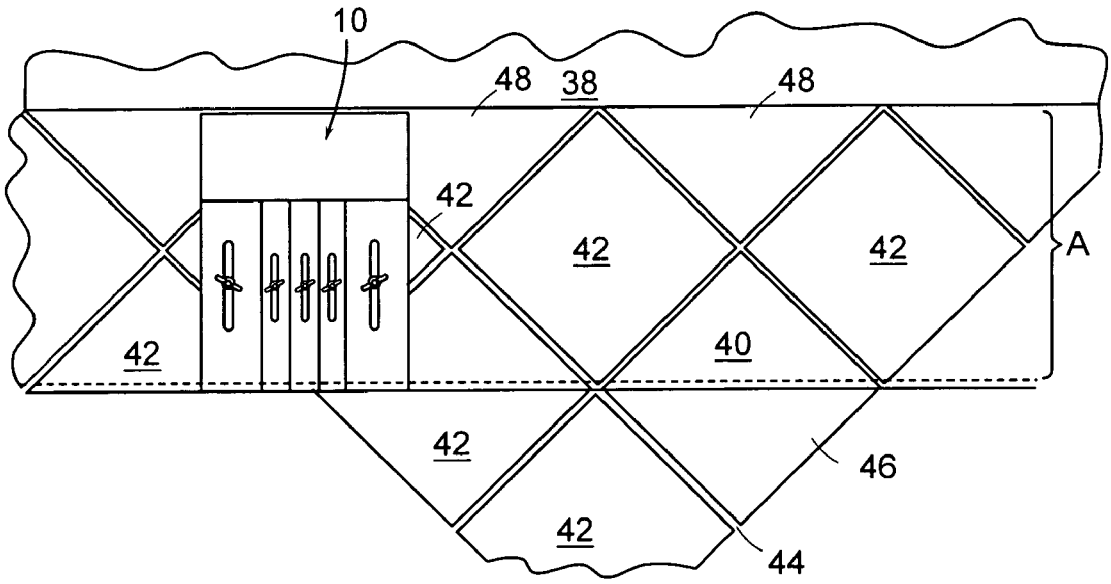
FIG. 4 is a plan view of the present invention in use at an angle to a wall.
Figure 5:
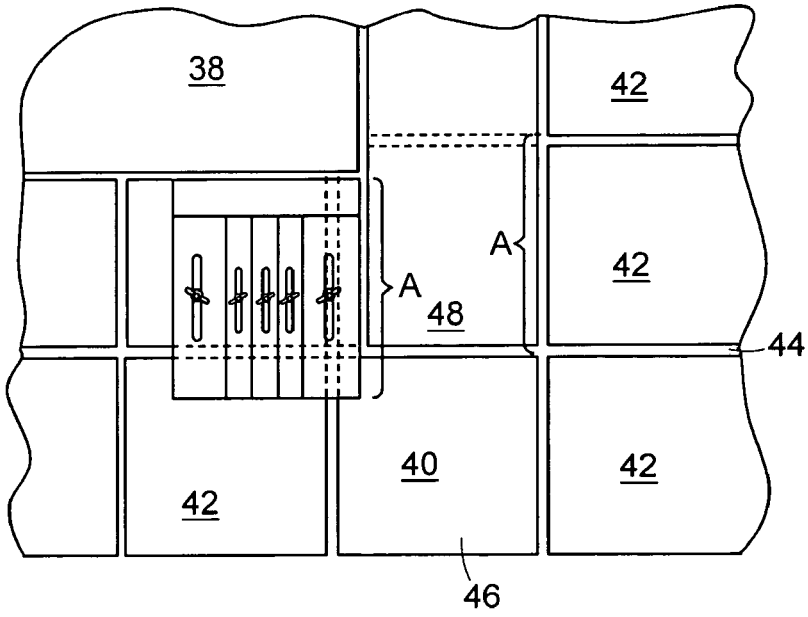
FIG. 5 is a plan view of the present invention in use around the corner of a wall.

Turning to FIGS. 4 and 5, it is shown that the tool 10 of the present invention is also readily adaptable for handling situations in which the empty space 48 is angled relative to the wall 38 (FIG. 4), or in which the empty space 48 wraps around the corner of a wall 38 (FIG. 5). In FIG. 4, the tool 10 is shown extended to a length A that corresponds to the diagonal dimensions of a tile 42 including any surrounding grout 44. A fresh tile 40 can be cut along a line perpendicular to the length of the tool 10 to create a new tile 46 that is shaped to fit in a plurality of spaces 48 along the wall 38. It is understood that this process can be repeated indefinitely to tile entire surfaces along the wall 38.

In FIG. 5, the space 48 is partially filled by the corner of the wall 38. In such a case, the tool 10 is similarly extended to a length A that includes the dimensions of tile 42 including any grout 44 that is required. A fresh tile 40 is then disposed below the space 48, and the tool 10 is aligned with the corner of the wall 38 as shown. The cut of fresh tile 48 will render a new tile 46 that is fitted to the space 48, including any grout 44 as noted above.

Figure 6:
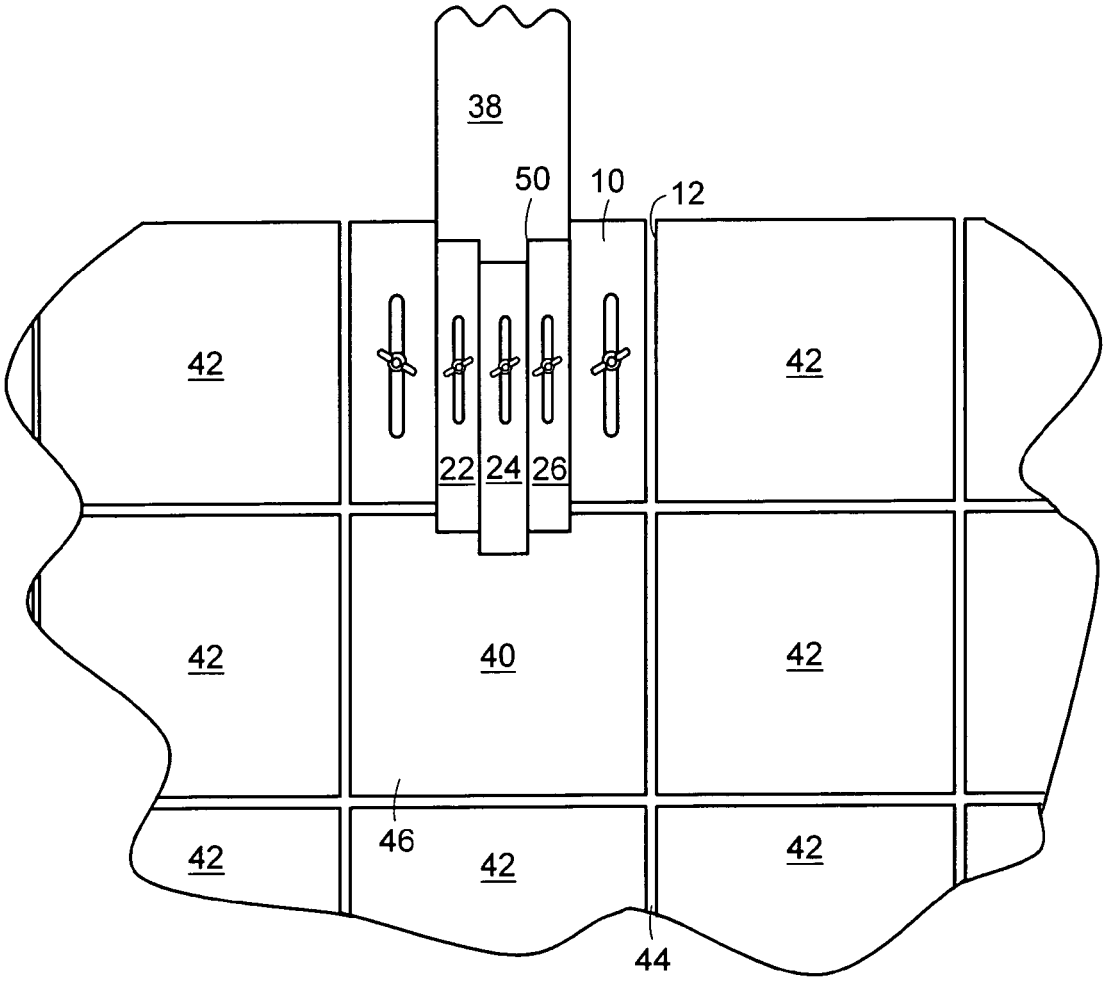
FIG. 6 is a plan view of the present invention in use around a door jam.

A particular application for which the tool 10 of the present invention is well-suited is tiling around a door jam as depicted in FIG. 6. In this instance, the wall 38 terminates in a door jam 50 of the type known in the art. Unlike existing tools for scribing tile, the present invention includes center members 22, 24, 26 that may be displaced relative to the base member 12 to accommodate the profile of the door jam 50. As in previous instances, the tool 10 is fitted to the contours of the door jam 50 and a fresh tile 40 is disposed such that the tool 10 partially overlaps it. The resultant new tile 46 will be fitted to the outline of the door jam 50, including any grout 44 that is necessary.

As described herein, the tool 10 of the present invention provides a reliable and consistent means for measuring and cutting tile to be fitted across a varying set of circumstances. The present invention can be used against flat walls, angled walls, corners, and door jams. Of particular note is that the present invention contains a plurality of moving members, including the edge members 20 and the center members 22, 24, 26 that are all movable relative to each other and to the base member 12. Thus, the edge members and center members 22, 24, 26 can be moved in concert to mimic a rectangular plate, as shown in FIGS. 3A, 3B, or the members can be moved independently for scribing tile in difficult circumstances, such as those described with reference to FIG. 6. In sum, the present invention is an economical and useful tool that is adaptable for a number of uses in the art of tile scribing.

It should be apparent to those skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

I claim:

1. A tool for scribing tile comprising:

a base member defining a substantially rectangular and substantially planar surface;

one or more edge member defining an edge opening, the one or more edge member disposable on the base member and coupled to the base member through the edge opening by at least two edge fasteners and slidable relative to the base member along the edge opening; and one or more center member defining a center opening, the one or more center member disposable on the base member and coupled to the base member through the center opening by one or more center fastener, wherein the one or more edge member is slidably enagable with the one or more center member.

2. The tool of claim 1 further comprising a first and a second edge member of the one or more edge member such that the one or more center member is arranged between the first and the second edge member, wherein the second edge member includes at least one second edge opening and disposed on the base member.

3. The tool of claim 2 further comprising a first and a second center member of the one or more center member are disposed adjacent one another and arranged between the first and second edge member.

4. The tool of claim 1 further comprising a lip defined at one end of the base member.

5. The tool of claim 4 wherein the lip defines a passage through which the one or more center member may pass.

6. The tool of claim 1 further comprising a plurality of feet for supporting the tool, the feet disposed on at least a portion of a bottom of the base member.

7. The tool of claim 1 further comprising a cutout defined in the base member adjacent to the one or more center member.

* * * * *